US005333839A

United States Patent [19]

Lonardi et al.

[11] Patent Number: 5,333,839

[45] Date of Patent: Aug. 2, 1994

[54] MACHINE FOR BORING A TAP HOLE OF A SHAFT FURNACE

[75] Inventors: Emile Lonardi, Bascharage, Luxembourg; Philippe Malivoir, Thionville, France; Jean Metz, Luxembourg, Luxembourg; Fernand Roemen, Luxembourg-Cents, Luxembourg; Patrick Milen, Fennange, Luxembourg

[73] Assignee: Paul Wurth S.A., Luxembourg, Luxembourg

[21] Appl. No.: 968,984

[22] Filed: Oct. 30, 1992

[30] Foreign Application Priority Data

Oct. 31, 1991 [LU] Luxembourg ..... 88029
Aug. 5, 1992 [LU] Luxembourg ..... 88157

[51] Int. Cl.[5] ..... C21B 7/12

[52] U.S. Cl. ..... 266/45; 266/271; 266/272

[58] Field of Search ..... 266/271, 272, 273, 45

[56] References Cited

U.S. PATENT DOCUMENTS 4,087,083 5/1978 Kozuka et al. ..... 266/273
4,602,770 7/1986 Mailliet et al. ..... 266/271
5,009,398 4/1991 Lonardi ..... 266/199
5,039,068 4/1991 Venturini et al. ..... 266/271
5,069,430 12/1991 Woodings et al. ..... 266/271
5,192,489 3/1993 Metz et al. ..... 266/271

FOREIGN PATENT DOCUMENTS 0379018 1/1990 European Pat. Off. .
33391 5/1985 Fed. Rep. of Germany .
2207741A 8/1987 United Kingdom .

*Primary Examiner*—Scott Kastler
*Attorney, Agent, or Firm*—Fishman, Dionne & Cantor

[57] ABSTRACT

A machine for boring a tap hole of a shaft furnace is presented for use in conjunction with a lost-rod process. In this process, a metal rod is driven into a botting mass, before it has completely hardened, and is removed later for opening a tap hole. Driving-in of the rod is performed with the aid of a to-and-fro movement of a clamp which can move over a mount through action of a first jack. Removal is performed with the aid of a continuous reverse movement of the clamp through the action of the first jack and of a powerful drive means, for example a second jack, driving the first jack towards the rear of the mount.

15 Claims, 5 Drawing Sheets

MACHINE FOR BORING A TAP HOLE OF A SHAFT FURNACE

TECHNICAL FIELD

The present invention relates to machines for boring a tap hole of a shaft furnace. More particularly, this invention relates to machines for boring a tap hole of a shaft furnace which utilizes the lost-rod process in which, after having sealed the tap hole with a botting mass, a metal rod is driven into the mass, before it has completely hardened, and is removed therefrom at the desired moment with a view to opening the tap hole, the machine having a mount, at least one support at the front of the mount, a sliding support at the rear of the mount and a clamp designed in order to grip the rod which traverses it and in order to transmit to it an axial force during the operation of inserting the rod into the botting mass, the clamp being mounted in a sliding manner on the mount and being movable along the latter through the action of a hydraulic jack having a stroke L which is shorter than the length of the rod.

BACKGROUND OF THE INVENTION

The machines used hitherto for implementing this lost-rod method are, in principle, conventional drilling machines. These machines are designed for drilling the tap hole with the aid of a drill bit coupled to a work member. This work member, which can be moved along the mount through the action of a drive means, consequently comprises a rotary drilling machine, a hammer supporting the drilling operation and a chuck for receiving the drill bit. These conventional drilling machines have undergone a number of transformations so that they can also be used for the above-mentioned application of the lost-rod process. Thus, the work members have been equipped with a powerful two-directional hammer for developing the energy necessary for the insertion and the removal of the boring rod, and the chuck has been replaced by a means for transmitting, to the rod, the energy thus developed by the hammer, for example with a clamp for gripping the free end of the rod.

In point of fact, a powerful hammer, as used on these machines, is not without drawbacks. Firstly, it imposes considerable stresses and vibrations on the equipment, particularly on the clamp for coupling with the rod which is therefore subject to rapid wear. It is also extremely noisy and often does not meet the increasingly severe standards aimed at reducing the level of noise in the industrial environment.

Patent Application EP 0,379,018 (corresponding to U.S. patent application No. 462,415 assigned to Paul Wurth S.A., the disclosure of both of which are incorporated herein by reference) provides indications for partially remedying these drawbacks. It proposes a multi-stage process for removal of the rod, using a to-and-fro movement of a clamp through the action of a silent hydraulic jack. The pneumatic hammer, which must no longer be two-directional since it is no longer used for removal, is nevertheless still necessary for efficient and rapid positioning of the boring rod.

The drawbacks of the hammer also encourage elimination of the hammering operation during the insertion stage. For example, it would be possible to envisage subjecting the work member to a more powerful drive means in order to cause the rod to penetrate forcibly and without vibrations into the semi-hardened sealing mass. Unfortunately, this plan seems a priori to be unworkable. In fact, given the length of the rod, a more powerful thrust without a hammer increases the risk of, firstly, buckling of the rod and, then, its permanent immobilization in a partially driven-in position in the mass which is rapidly hardening.

An ingenious solution to the problem of forceable insertion of the rod is suggested in Luxembourg Patent Specification LU-87 915 (corresponding to U.S. patent application No. 862,487 assigned to Paul Wurth S.A., the disclosure of both of which are incorporated herein by reference). This patent proposes a two-directional clamp whose alternating to-and-fro movement at the front of the mount is used both for insertion and for removal of the boring rod. This proposal thus seems to be the optimum solution in that it makes it possible to dispense completely with the noisy and destructive hammer of the clamp. A disadvantage of this machine is that the two-directional clamp and the means which actuate it are located in the front region of the mount. In point of fact, this region is a zone which is at risk from splashes when the molten stream issues from the tap hole after removal of the rod.

SUMMARY OF THE INVENTION

The above-discussed and other problems and deficiencies of the prior art are overcome or alleviated by the machine for boring a tap hole of a shaft furnace of the present invention. In accordance with the machine of the present invention a jack is itself mounted in a sliding manner on a mount and can be moved along the latter through the action of a powerful drive means, and in that a coupling means, designed for transmitting an axial force to the free end of a rod in the direction of the removal thereof, is securely attached to a clamp during the operation of removal of a rod from the tap hole.

The removal of the rod is thus no longer carried out by an alternating to-and-fro movement of the clamp at the front of the mount, but by a continuous reverse movement of the clamp through the combined action of the hydraulic jack and of its drive means. The clamp and the jack are thus clear of the zone which is at risk from splashes in front of the opening of the tap hole, and the spurtings of the stream of molten materials. Moreover, the danger of dirt accumulation for the clamp is substantially reduced, since the boring rod removed from the tap hole no longer passes through the clamp. In fact, the latter is rendered securely attached to the free end of the boring rod emerging from the tap hole and remains securely attached thereto until the end of the removal operation. Finally, removal becomes more rapid, given that it is carried out by a continuous movement and no longer involves the to-and-fro movement of the clamp.

It is pointed out that the insertion of the boring rod into the botting mass is performed in the following manner:

after having slipped the boring rod through the clamp and having rendered it securely attached to the support sliding at the rear of the mount, the open clamp is brought forward, by actuating the drive means at a distance L from the front of the mount which corresponds approximately to the stroke L of the jack. The clamp is closed and the rod is advanced, with the aid of the clamp, by the length L via an extension of the jack. The clamp is then opened and brought back to the distance L from the front of the mount via a retraction of the jack. The clamp is again closed and the rod is advanced by a second length L via another extension of the jack. This to-and-fro movement of the clamp over the said distance L at the front of the mount is repeated until the rod is driven into the tap hole over the desired length.

It should be noted that the said length L, that is to say the stroke of the jack, is determined so as to prevent buckling of the rod during its insertion.

In a first preferred embodiment, the powerful drive means comprises a second hydraulic jack. This is a reliable drive means with a simple control system and a relatively low cost price.

This second jack is advantageously mounted on the mount so that the cylinder of the first jack is securely attached to the cylinder of the second jack and that the end of the piston rod of this second jack is anchored at the rear of the mount. This mounting method makes it possible to achieve a particularly small overall machine length which represents a certain advantage, given the generally restricted space available around the blast furnace.

The second jack is then advantageously supplied with a hydraulic fluid through its piston rod and the first jack is advantageously supplied through the second jack. This solution dispenses with the use of flexible or articulated pipes for supplying the two jacks with hydraulic fluid. Over-encumbering of the machine is thus avoided and, at the same time, the risk of tearing-away of a hydraulic conduit is reduced.

In a second embodiment, the powerful drive means includes at least one endless chain installed axially in the mount and a motor, whose direction of rotation may be reversed, installed at the rear of the mount. A main advantage of this second embodiment is the lower height of the machine. In fact, the chain is much less cumbersome than the second jack of the first preferred embodiment. Moreover, the use of the chain to replace the second jack also makes it possible to produce smaller lever arms in the transmission of the tensile forces to the first jack. The result of this is that the contact pressures to which the sliding members of the first jack and of the clamp are subjected are markedly reduced, which makes it possible to give the members a smaller size. The stroke of the movement of the first jack on the mount is advantageously limited by a first stop and a second stop which are securely attached to the mount. The distance between these two stops is approximately equal to the difference between the length of the boring rod and the stroke L of the first hydraulic jack.

It will be noticed that the clamp is preferably supported by a first carriage, whilst the first jack is supported by a second carriage. The first and the second carriage are then guided, during movement on the mount, by at least one pair of parallel rails which are securely attached to the mount. The axis of the piston rod of the first jack is advantageously contained in the plane passing through the axes of the two rails. This mounting makes it possible to achieve excellent guiding of the clamp and of the first jack on the mount, with simple means, and, at the same time, reduces as far as possible the lever arms in the transmission of forces.

The coupling means, utilized for transmitting an axial force to the free end of the rod in the direction of the removal of the latter, is advantageously integrated into the clamp. This coupling means may, for example, consist of a transverse wedge which interacts with a flat part machined in the end of the rod in order to immobilize the latter axially in the clamp.

The clamp used on the machine may, however, also be a two-directional clamp, such as is described, for example, in Luxembourg Patent Specification LU-87 915 (corresponding to U.S. patent application Ser. No. 862,487 assigned to Paul Wurth S.A., the disclosure of both of which are incorporated herein by reference) or in the specification of Patent of Addition LU-88 020 (also corresponding to U.S. patent application Ser. No. 862,487 assigned to Paul Wurth S.A., the disclosure of both of which are incorporated herein by reference). This clamp makes it possible to grip the rod with a first of pair jaws during the operation of insertion of the rod via a to-and-fro movement. During the operation of removal of the rod, the free end of the latter is rendered securely attached to the clamp by means of a second pair of jaws. The latter are arranged in the clamp so as to transmit a tensile force in the direction of the removal of the rod. It will be noted that the use of a pair of jaws for the removal of the rod has the advantage of being able to work with smooth rods which do not require preparatory work on the rod, such as the machining of a flat part.

In an alternate embodiment, the coupling means, used for transmitting an axial force to the free end of the rod in the direction of the removal of the latter, is integrated in a coupling mounted on a work member which can slide freely on the mount. The coupling may be also equipped with a support surface arranged so that the clamp can bear on the latter during its reverse movement.

Because the clamp can bear directly on the coupling which is securely attached to the work member, the latter is simply pushed in front of the clamp and must not itself transmit any tensile force. It is obvious that, in this case, the clamp will not have to include special means in order to be coupled to the end of the rod to be removed, which makes it structurally simpler. It remains to be noted that, if it is desired to automate the coupling means integrated in the coupling which is securely attached to the work member, there will already be available on the latter a supply of hydraulic fluid which is suitable for this purpose. In this manner, it is possible to avoid the installation of an additional supply conduit towards the clamp.

In preferred embodiment, the work member has means for being coupled to the first carriage supporting the clamp so as to be movable by the latter. In this manner, there is no need to install, on the mount, a second drive means for the work member, which reduces the manufacturing costs of the machine.

The support at the front of the mount advantageously includes of two pivoting flaps which define between them a passage and support opening for the rod and which at the same time form a shield for protection against the splashes originating from the tap hole.

The machine may also include a support which can move along the mount. This movable support may then act as the front support of the boring rod.

The present invention has numerous features and advantages relative to the prior art. For example, the present invention eliminates any risk of dirt accumulation and of destruction of the clamp during the operation of removal of the rod. It offers the advantage of being able to work without a hammer, both during the operation of removal of the rod and during the operation of insertion of the rod. It follows that the machine no longer has any problem in complying with regulations regarding the reduction of the level of noise in an industrial environment, and that the equipment, and more especially the clamp, is no longer subjected to considerable vibrations which give rise to rapid wear. It will also be appreciated that dispensing with the two-directional hammer simplifies the construction of the said work member, which increases the reliability of the latter and, at the same time, reduces its cost price.

An object of the present invention is to eliminate the risk of dirt accumulation and of destruction of the clamp and of its drive jack during the operation of removal of the rod, while retaining the advantages acquired.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figures 1, 2, 3:
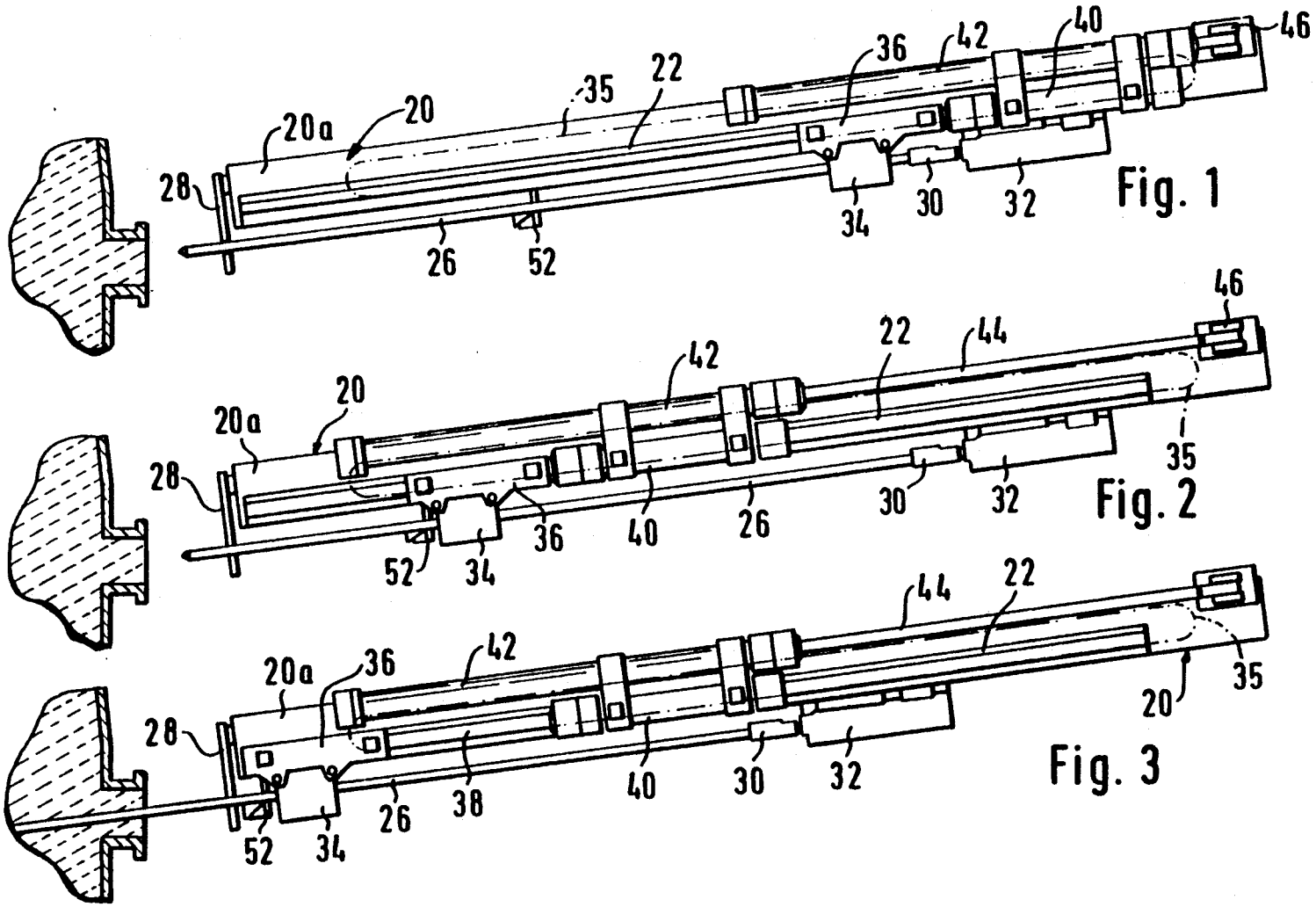
FIG. 1 is a longitudinal sectional view of a boring machine of the present invention positioned for the insertion of a boring rod into a botting mass.
FIG. 2 is a sequential view of FIG. 1, just before the first movement of insertion of the boring rod.
FIG. 3 is another sequential view of FIG. 1, just after the first movement of insertion of the boring rod.
Figure 6:
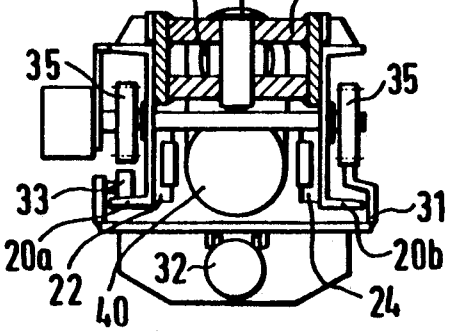
FIG. 6 is a sectional view through the plane A—A in FIG. 5.

For the description of the construction of the machine, reference is first made to FIGS. 1 and 6. The framework of the boring machine consists of a mount 20. This mount 20 is, for example, supported in a conventional and known manner at the end of a carrier arm (not shown). This carrier arm can pivot about a bracket in order to move the mount 20 between a parked position and an operating position, and vice versa.

The mount 20 may, for example, be formed from two parallel girders 20*a*, 20*b* which are joined together (FIG. 6). Only the girder 20*a* can be seen in FIG. 1, the girder 20*b* having been removed in order to show more details. The two girders 20*a* and 20*b* each comprise, on the inner face thereof, a rail 22 and 24 respectively. These two rails are disposed parallel and opposite. Only the rail 22 is shown in FIG. 1.

The reference 26 denotes a boring rod, also known as a lost rod, for the process described hereinabove. This rod is preferably carried at the front of the machine by a stationary support 28, for example a support of the type proposed by European Patent Application EP 0,064,644 incorporated herein be reference. The support 28 comprises two flaps mounted at the front of the mount 20 which are able to pivot between an open position, facilitating the engagement and the seizing of the rod 26 for the removal of the latter and a closed position, in which, between them, they define an opening supporting the rod 26. The two flaps thus form a support for the rod 26 and, at the same time, form a shield for protection against the splashes originating from the stream of the tap hole.

Figure 5:
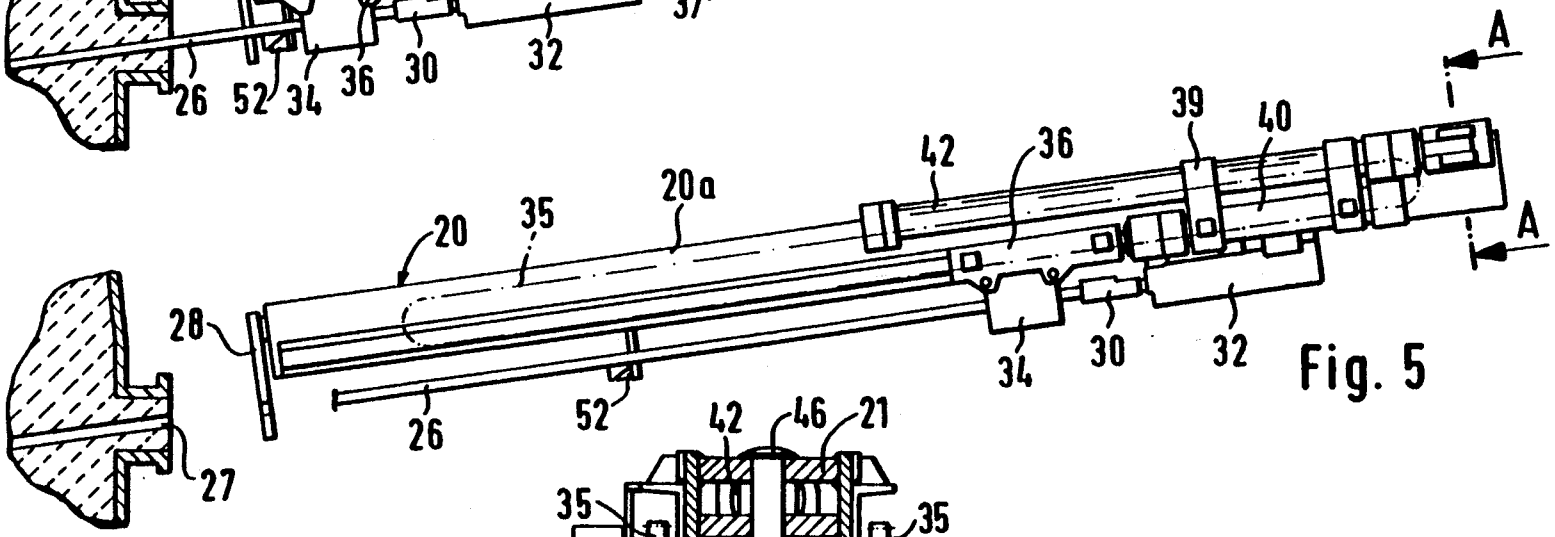
FIG. 5 is yet a further sequential view of FIG. 1, after the removal of the rod.

An intermediate support 52 is provided and is slidable along the mount 20 and whose construction and operation are the subject of Patent Specification GB 2,216,827 (corresponding to U.S. Pat. No. 5,039,068 assigned to Paul Wurth S.A., the disclosure of both of which are incorporated herein by reference). The aim of its presence is to support the rod 26 after its removal from the tap hole, that is to say when it is no longer supported by the front support following a shortening due to the disappearance of its tip by melting in the furnace (FIG. 5).

At the rear, the rod 26 is supported by a work member 32 and by means of a coupling 30 which is securely attached to the latter. This work member is supported by a carriage 31 (FIG. 6) sliding along the mount 20, for example with the aid of rolling rollers 33 (one of which is shown in FIG. 6). These rollers 33 move, for example, along the outer sides of the two girders 20*a* and 20*b* of the mount 20. The carriage 31 is connected to two endless chains 35 provided outside the girders 20*a* and 20*b* and which are intended to move the carriage 31 and the tool 32 during a conventional drilling operation. These chains 35 are thus not used for implementing the lost-rod process according to the present invention.

The work tool (or member) 32 which includes, conventionally, a rotary drilling machine and a hammer, is also not used in the lost-rod method. The presence of a drilling machine and of a hammer is necessary only for drilling the tap hole with a drill bit according to the conventional process. The result of this is that, if the conventional drilling operation is unnecessary or if this drilling operation can be performed in another way, the work member 32 may be dispensed with and replaced simply by sliding support ensuring support of the boring rod 26 at the rear.

A clamp 34 is provided, for example a two-directional clamp of the type proposed in U.S. patent application Ser. No. 862,487. This clamp includes, in this case, a first pair of jaws arranged around a channel for passage of the rod so as to be able to grip the rod 26 in order to transmit thereto an axial force in the direction of the insertion of the rod into the botting mass; and a second pair of jaws arranged around this same channel so as to be able to grip the rod 26 in order to transmit thereto an axial traction in the opposite direction, that is to say in the direction of the removal of the rod 26 from the tap hole.

The clamp 34 is supported by a carriage 36 mounted, for example, on blocks 37 which can move in the rails 22 and 24 of the mount 20. It shall be understood that the clamp 34 can, for example, operate pneumatically and must thus be connected to the pneumatic circuit of the machine by appropriate means, for example flexible pipes or pipes with articulations.

The carriage 36 is fastened to a piston rod 38 of a hydraulic jack 40. This jack 40, which has a stroke L, is installed on a second carriage 39 mounted, for example, on blocks 37' guided in the rails 22 and 24 of the mount 20. It should be noted that the axis of this jack is parallel to the axes of the rails 22 and 24 and is placed, within the limits of the space available on the mount, in such a manner as to optimize the contact pressures on the blocks 37 and 37'. In FIG. 1, the axis of the jack 40 is, for example, contained in the plane passing through the axis of the rails 22 and 24, and it follows that the transmission of the forces between the second carriage 39 and the jack 40 does not create an additional moment which increases the contact pressures.

In a preferred embodiment a drive means is illustrated by employing a second hydraulic jack 42. Shown in FIGS. 1 to 7 the second carriage 39 supports the cylinder of the first jack. 40 and is rendered securely attached to the cylinder of the second jack 42 which is longer than the jack 40. This jack 42 is parallel to the first jack 40 and oriented in the opposite direction from the latter, that is to say that its piston rod 44 is anchored, at the rear, on the mount 20 by fastener 46 (FIG. 6). The first jack 40 can, consequently, be moved along the mount 20 through the action of the jack 42, when the cylinder of the latter is disengaged from its piston rod 44. Naturally, the jack 42 could be oriented in the same direction as the jack 40, but the embodiment shown in FIGS. 1 to 5 merits preference, given that the jack 42 does not extend the machine. In fact, if it were oriented in the same direction, the cylinder of the jack 42 would have to be disposed at the rear in the extension of the mount 20.

Figure 7:
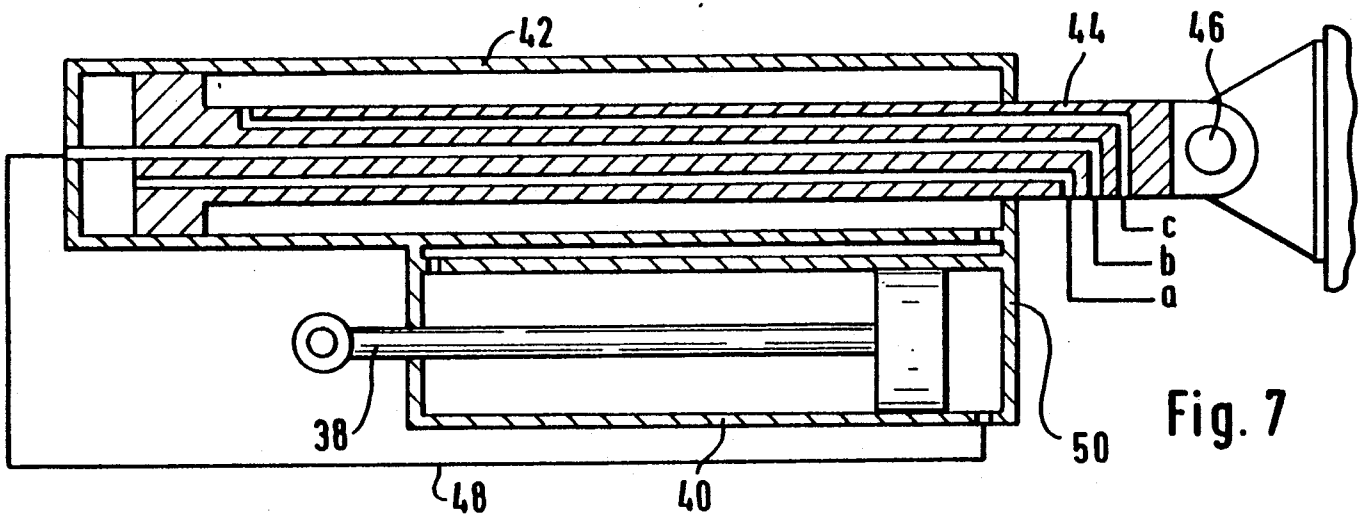
FIG. 7 is a block diagram of the hydraulic supply of two jacks of the machine according to the present invention as depicted in FIGS. 1 to 6.

FIG. 7 shows the preferred embodiment of the hydraulic supply of the two jacks 40 and 42. The jack 42 is supplied through two conduits a and c traversing its piston rod 44. The jack 40 is supplied, on the one hand, for the disengagement of its rod 38, by a conduit b axially traversing the entire jack 42 and extended by an exterior conduit 48 as far as the cylinder of this jack 40 and, on the other hand, for the removal of its rod 38, by a direct communication 50 with the cylinder of the jack 42 so as to be connected by the latter to the conduit c. It will be understood that the supply of the two jacks could also be achieved by exterior telescopic conduits. Both the supply via telescopic conduits and that shown in FIG. 7 enable the presence of flexible pipes, which are always dangerous, or of cumbersome articulated conduits to be minimized.

A description will now be given of the operation of the machine for inserting the rod 26 into the tap hole and for removing it therefrom. For insertion of the rod 26, the latter is loaded into the machine, preferably when the mount is in the parked position and the two jacks 40 and 42 occupy the positions according to FIG. 1. Loading is performed by slipping the rod 26 through the clamp 34 in the coupling 30 of the work member 32. During this loading, the flaps of the front support 28 are preferably open in order to facilitate loading of the rod 26 and are closed again immediately afterwards in order to support the front part of the rod 26.

When the rod 26 is in place according to FIG. 1, the jack 42 is fully actuated in order to cause the jack 40 and the clamp 34 to advance into the position according to FIG. 2, which is located approximately at a distance L, equal to the stroke L of the jack 40, from the front of the mount. The clamp 34, which is not closed, can slide freely relative to the rod 26 which is held by the work member 32. In principle, it would be possible to advance the jacks 40 and 42 into the operating position according to FIG. 2 before loading the rod 26, but it is easier to engage the rod when the jacks 40 and 42 occupy the withdrawn position according to FIG. 1.

From the position of FIG. 2, it is possible to begin the procedure of insertion of the rod 26 into the botting mass of the tap hole. This operation may be performed in a similar manner as that described in U.S. patent application Ser. No. 862,487. To this end, the jack 40 and the clamp 34 are activated simultaneously, which has the result that the clamp 34 is closed and is moved by a distance L from the position of FIG. 2 toward that of FIG. 3, driving the rod 26 and the work tool 32. The direction of the hydraulic fluid is then reversed which has the result that the clamp 34 opens and reverses through the action of the jack 40 into the starting position of FIG. 2. The rod 26 remains in place, given that the clamp 34 is open and can slide along the now stationary rod 26. This to-and-fro movement of the clamp 34 over a stroke L is then repeated as many times as necessary in order to insert the rod 26 into the tap hole.

In order to remove the rod from the tap hole, the mount 20 is moved towards the tap hole. The support 28 is preferably open in order to not collide with the end of the rod 26 emerging from the tap hole. The clamp 34 is then moved by the two pistons 40 and 42 into the position of FIG. 4 in which, when the mount is correctly positioned, the free end of the rod 26 in the tap hole is engaged through the clamp 34. The supply circuit of the clamp 34 is then reversed so that the clamp 34 closes. The two jacks 40 and 42 are then actuated simultaneously, which has the result of withdrawing the two jacks 40 and 42 in the direction of the position of FIG. 5, the clamp 34 entraining the rod 26. The support 28 has been closed before the triggering of the withdrawal movement of the clamp 34 in order to support the rod 26 when its end is disengaged from the furnace and in order to form a shield for protecting the front part of the machine.

Figure 4:
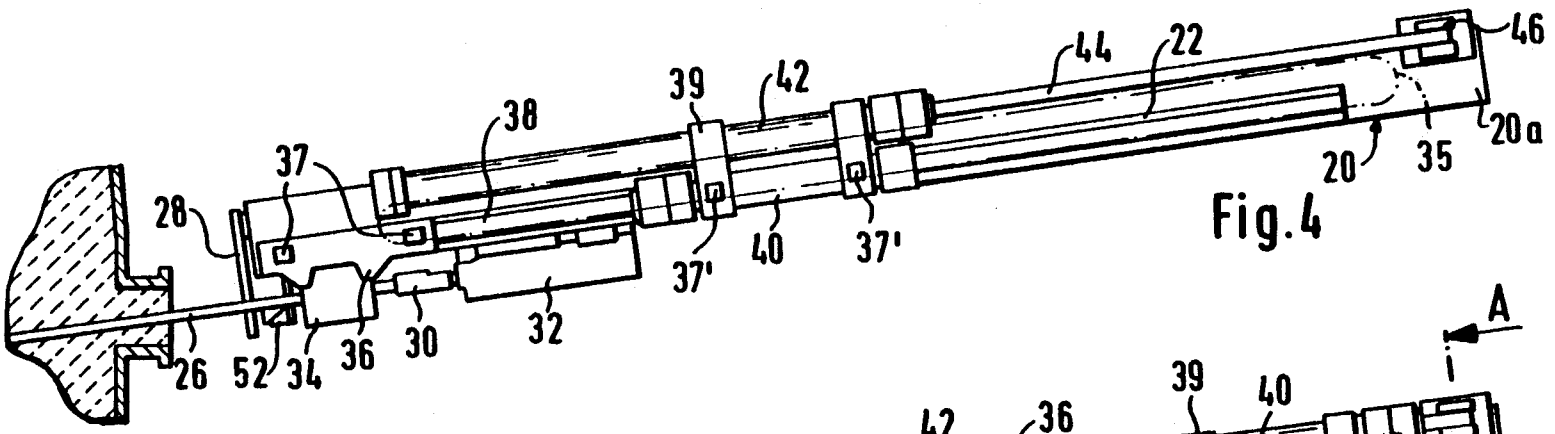
FIG. 4 is a further sequential view of FIG. 1 in the stage of preparation for the removal of the rod.

When the two jacks 40, 42 are mutually well balanced and when the active surfaces of their pistons are equal, they operate simultaneously so that their actions are superposed in order to accelerate the movement of the clamp 34 from the position of FIG. 4 towards that of FIG. 5.

The clamp 34 no longer performs the to-and-fro movement at the front of the machine during the removal stage, but it is reversed in a continuous movement towards the position of FIG. 1. The clamp 34 is thus rapidly moved away from the dangerous zone and is protected from splashes when the front end of the rod 26 frees the tap hole and the molten material gushes from the latter.

The following table summarizes the coordinated supply of the two jacks for the removal and the insertion of the rod 26 (see also FIG. 7).

| | | Conduits | | |
|---|---|---|---|---|
| | | a | b | c |
| Insertion | 1) jack 42: disengagement | x | o | o |
| | 2) jack 42: disengaged<br>jack 40: disengagement | x | x | o |
| | 3) jack 42: disengaged<br>jack 40: retraction | x | o | x |
| | . . . repetition 2) + 3) . . . | | | |

-continued

| | | Conduits | | |
|---|---|---|---|---|
| | | a | b | c |
| | 4) jack 42: retraction<br>jack 40: retraction | o | o | x |
| Removal | 5) jack 42: disengagement<br>jack 40: disengagement | x | x | o |
| | 6) jack 42: retraction<br>jack 40: retraction | o | o | x |

x: pressurized conduit
o: depressurized conduit

Insertion steps 1–4 are performed successively by the control of pressures in the conduits a, b, c to insert the rod 26 into the botting mass. Steps 2 and 3 are repeated several times in order to ensure the alternating to-and-fro movement of the clamp 34 between the positions of FIGS. 2 and 3. The removal of the rod 26 according to FIGS. 4 and 5 comprises the steps 5 and 6.

FIGS. 8 to 11 which illustrate an alternate embodiment of the drive means of the jack 42 on the mount 20.

In these FIGURES, it can be seen that at least one endless chain 64 is mounted between the two girders 20*a* and 20*b*, parallel to the rail 22 and 24. This chain 64, which preferably has its two sides 64', 64'' superposed, is stretched between a driven toothed wheel 65, mounted at a certain distance from the front of the mount 20, and a driving toothed wheel 66, mounted at the rear of the mount 20. The driving wheel 66 is driven by at least one motor 62, fastened to the rear of the mount 20. This is preferably a hydraulic motor whose direction of rotation can be reversed by any suitable control system.

The carriage 39 supporting the jack 40 is fastened to the lower side 64'' of the endless chain 64 and can, consequently, be driven thereby between a stop 60 mounted in the vicinity of the driven wheel 65 and a second stop 61 mounted in the vicinity of the driving wheel 66. The travel of the carriage 39 between the two stops 60 and 61 corresponds approximately to the difference between the length of the boring rod and the stroke L of the jack 40. It should be noted that the lower side 64'' of the chain 64 is preferably as close as possible to the plane containing the axes of the rails 22 and 24 in order to avoid any additional moment in the transmission of forces.

The operating principle of this machine of FIGS. 8 to 11 is the same as that described for the machine of FIGS. 1 to 7. The movement of the jack 40 to a distance L from the front of the mount 20 and the reverse of the jack 40 from this position towards the rear of the mount is performed by a rotation of the endless chain 64, either in one direction or in the other direction. The to-and-fro movement of the clamp 34 for the insertion of the boring rod 26 is naturally performed by the jack 40.

In order to remove the boring rod 26 from the tap hole, the mount 20 is moved towards the tap hole. The carriage 39 is moved, by a rotation of the motor 62, against the front stop 60. When the mount is correctly positioned, the piston rod 38 of the jack 40 has emerged and the free end of the rod 26 engages through the clamp 34 which is open. The supply circuit of the clamp 34 is then reversed so that the latter closes. The motor 62, for withdrawing the carriage 39, and the jack 40, for retracting the piston rod 38, are then simultaneously actuated. The piston and the motor are preferably balanced so that the piston rod 38 is retracted entirely before the carriage 39 of the jack 40 collides with the rear stop 61. Thus, the hydraulic supply of the jack and of the motor may advantageously be cut automatically by a limit-of-travel switch associated with this stop 61.

It should be pointed out that a forceable removal of the rod 26 by the work member 32 is impossible since it is well known that the work member 32, containing at least one rotary drilling machine and a hammer, is normally not dimensioned in order to transmit a considerable tensile force to the rod 26. Therefore, it will be understood that for the removal operation a coupling 30 of the work member 32 is provided for transmitting a tensile force to the rod.

Figure 8:
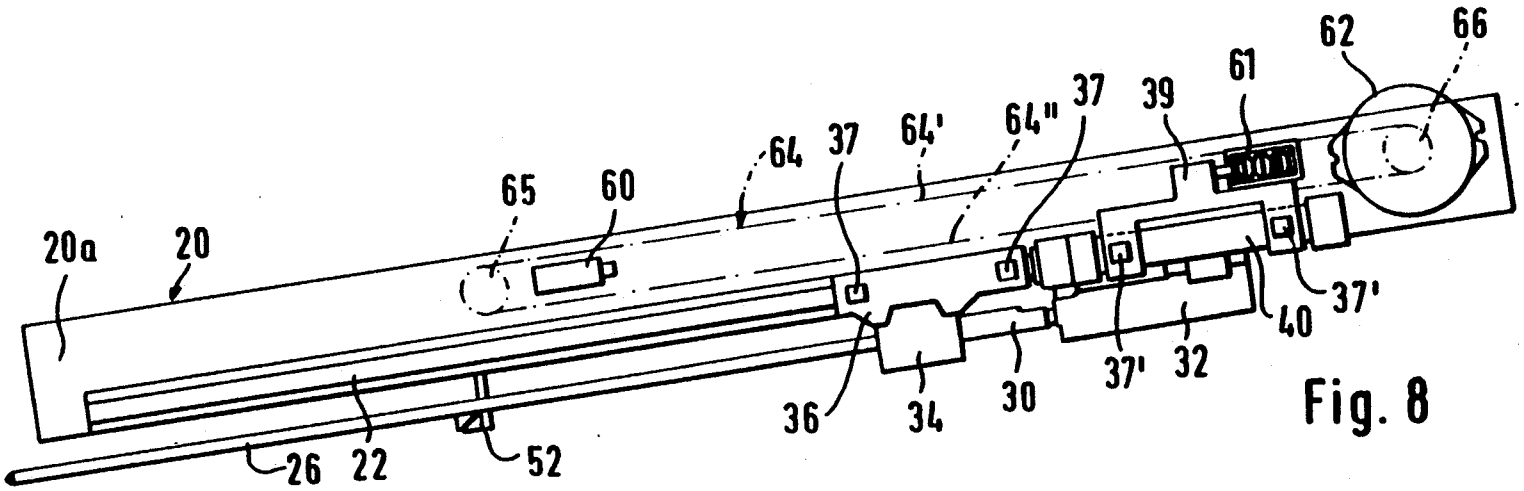
FIG. 8 is a longitudinal sectional view of an alternate embodiment of the boring machine according to the present invention, in the position of preparation for the insertion of a boring rod into a botting mass.
Figure 9:
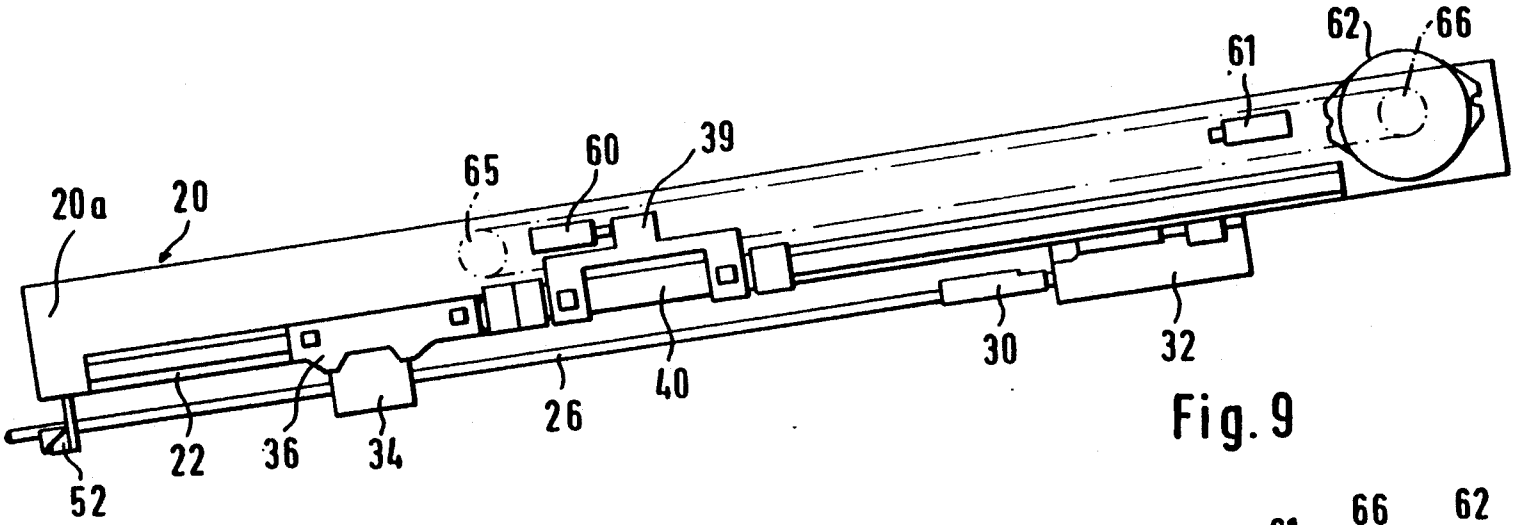
FIG. 9 is a sequential view of FIG. 8, just before the first movement of insertion of the rod.
Figure 10:
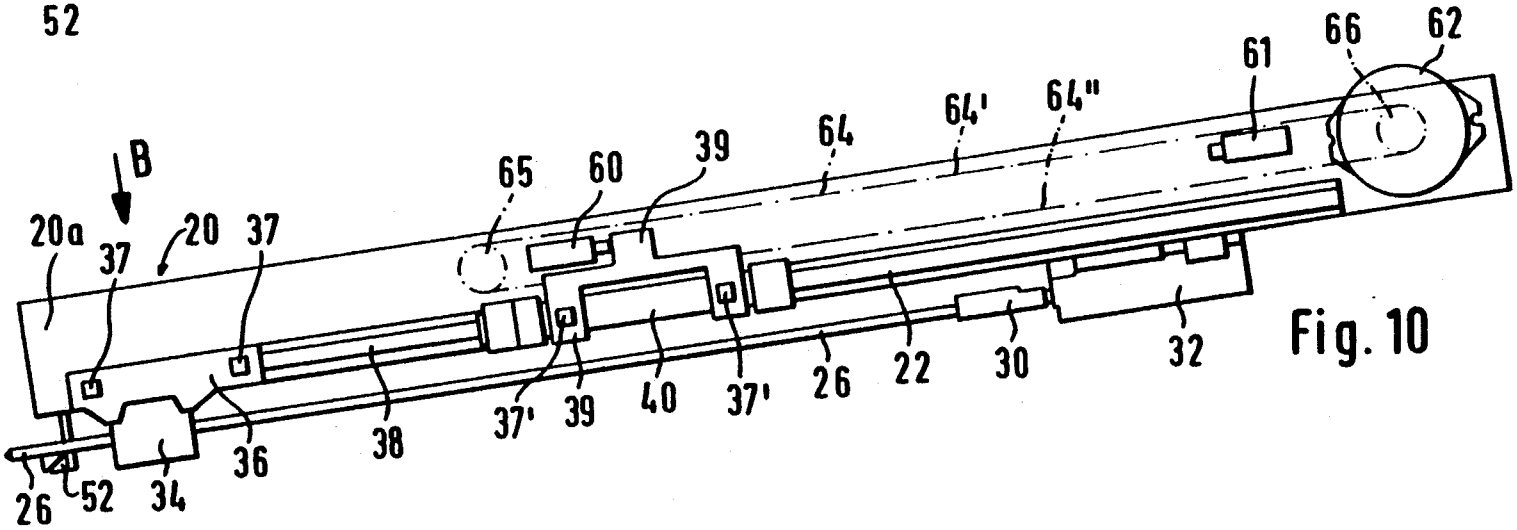
FIG. 10 is another sequential view of FIG. 8, just after the first movement of insertion of the rod.
Figure 11:
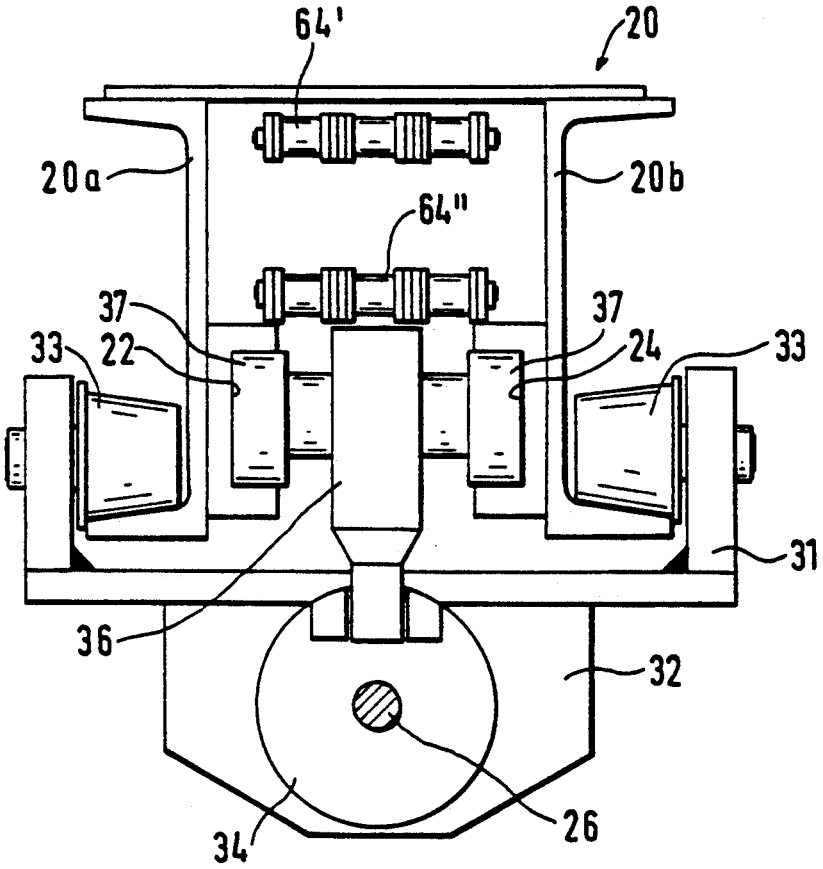
FIG. 11 is a transverse sectional view through the boring machine according to the alternate embodiment of FIG. 8.

This coupling 30, securely attached to the work member 32, is equipped with means for transmitting a considerable tensile force to the free end of the rod 26. Thus, the coupling 30 may, for example, be a clamp with jaws, of the type described in U.S. patent application Ser. No. 462,415. It would also be possible, however, to use a transverse-wedge coupling or any other type of coupling permitting transmission of a considerable tensile force to one end of the rod. The clamp 34 may, in this case, be a unidirectional clamp, used for the insertion of the rod 26. The clamp 34 is left open and the free end of the rod 26 traverses it in order to be rendered securely attached to the coupling 30. Upon its rearward return, the clamp 34 bears directly on a surface of the coupling 30 and thus pushes the work member 32 in front of it (FIG. 8). Given that the transmission of the tensile force takes place directly on the coupling 30 and not on the work member 32, the latter will not have to withstand any tensile force. It will simply precede the clamp 34 and the coupling 30 during their reverse movement. This structure of coupling 30 allows for the structure of the clamp 34 to become simpler, since it has to comprise only a single pair of jaws. Moreover, it has to be connected to only one control circuit.

It will be noted, moreover, that the carriage 36 supporting the jaw 34 and the carriage 31 supporting the work member 32 may be rendered securely attached to each other. To this end, a hook securely attached to the carriage 31 may be engaged manually or automatically in a stud securely attached to the carriage 36. Thus, the work member 32 has no need for its own drive system on the mount 20 in order to perform, for example, a drilling operation with a conventional drill bit.

It remains to be noted that, if the work member 32 is not used, it will preferably be immobilized at the rear of the mount with the aid of an automatic or manual brake.

It will be appreciated that the present invention proposes a machine which, due to its robust and efficient design, certainly provides substantial technical progress to the said lost-rod process. In particular, it will be appreciated that, due to its virtually silent operation, it contributes to a substantial reduction in noise pollution in the industrial environment.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for piercing a taphole for a shaft furnace having previously been plugged with taphole clay, the device comprising:

a rod having a front end and a rear end, the front end of said rod being driveable into an unhardened taphole clay;

a mount having a front and a rear;

a front support for supporting the rod at the front of said mount;

a sliding rear support for supporting the rod at the rear of said mount;

a first clamp, mounted in a sliding manner on the mount, the rod passing axially through said first clamp, said first clamp including means for releasably gripping the rod at any place between its front end and its rear end and for transmitting an axial pushing force to said rod in order to drive it into the taphole clay;

a first hydraulic jack slidably disposed on said mount, said first hydraulic jack having a stroke L which is shorter than the length of said rod, said first clamp being connected to said first hydraulic jack;

a drive means for moving said first hydraulic jack along said mount from a front position to a rear position and vice versa, said drive means being disposed on said mount; and a coupling means for engaging the rear end of said rod, said coupling means being adapted for transmitting an axial pulling force to said rear end of the rod for pulling said rod out of a hardened taphole clay and said coupling means being securely attached to said clamp means during removal of said rod from the taphole clay.

2. The device of claim 1 wherein said drive means comprises a second hydraulic jack.

3. The device of claim 2 wherein:

said first hydraulic jack includes a first cylinder and a first piston rod;

said second hydraulic jack includes a second cylinder and a second piston rod;

said first piston rod being securely attached to said first clamp;

said first cylinder being securely attached to said first cylinder, and said second piston rod being anchored to said rear of said mount.

4. The device of claim 3 wherein said second piston rod comprises:

means for passing a hydraulic fluid from the rear of the mount through said second piston rod towards said first cylinder and said second cylinder.

5. The device of claim 4 wherein said means for passing a hydraulic fluid towards said second cylinder comprises:

a conduit means axially traversing the entire second piston rod and the entire second cylinder.

6. The device of claim 1 wherein said drive means comprises:

an endless chain extending in an axial direction along said mount and interconnected therewith;

a motor for driving said endless chain which is disposed at said second end of said mount, said motor being adapted for driving said endless chain in opposing directions.

7. The device of claim 6 further comprising:

first and second stops disposed on said mount, said first stop being disposed at a distance from said second stop, said first and second stops for limiting a stroke of a movement of said first hydraulic jack on said mount said distance being approximately equal to the difference between the axial length of the boring rod and the stroke L of the first hydraulic jack.

8. The device of claim 4 including:

a first carriage for supporting said clamp means;

a second carriage for supporting said first hydraulic jack; and at least one pair of parallel rails which are securely attached to said mount, said first carriage and said second carriage being guided in their movement by said rails.

9. The device of claim 8 wherein:

said pair of parallel rails each have axes; and said pair of parallel rails being mounted to said mount whereby a plane which passes through the axes of said pair of parallel rails also passes through an axis of said first piston rod of said first hydraulic jack.

10. The device of claim 1 wherein:

said coupling means is integrally connected with said clamp means.

11. The device of claim 10 wherein said coupling means comprises:

a pair of jaws which are disposed within said clamp means and are adapted for transmitting a pulling force, said tensile force being in a direction generally toward removal of said boring rod from the botting mass.

12. A device for piercing a taphole for a shaft furnace having previously been plugged with taphole clay, the device comprising:

a rod having a front end and a rear end, the front end of said rod being driveable into an unhardened taphole clay;

a mount having a front and a rear;

a front support for supporting the rod at the front of said mount;

a sliding rear support for supporting the rod at the rear of said mount;

a first clamp, mounted in a sliding manner on the mount, the rod passing axially through said first clamp, said first clamp including means for releasably gripping the rod at any place between its front end and its rear end and for transmitting an axial pushing force to said rod in order to drive it into the taphole clay;

a first hydraulic jack slidably disposed on said mount, said first hydraulic jack having a stroke L which is shorter than the length of said rod, said first clamp being connected to said first hydraulic jack;

a drive means for moving said first hydraulic jack along said mount from a front position to a rear position and vice versa, said drive means being disposed on said mount;

a coupling means for engaging the rear end of said rod, said coupling means being adapted for transmitting an axial pulling force to said rear end of the rod for pulling said rod out of said hardened taphole clay and said coupling means being moveable as a unit with said clamp means during removal of said rod from the taphole clay; and a work member which is slidably connected to said mount, said coupling means mounted to said work member, said coupling means including a surface which is adapted to directly engage said clamp means during removal of said rod from the taphole clay.

13. The device of claim 9 including:

a work member having means for engaging said first carriage wherein said first carriage is adapted to move said work member.

14. The device of claim 1 wherein said first support includes:

two pivotable flaps defining a passage and a support opening for said boring rod, said two pivotable flaps also adapted to form a shield from discharge from the tap hole.

15. A process for piercing a taphole for a shaft furnace according to a method in which, after having plugged the taphole with taphole clay, a metal rod, having a front end and a rear end, is driven with its front end into this clay before it has fully hardened and is extracted out of the hardened clay, in order to open the taphole, employing a machine comprising:

a rod having a front end and a rear end, the front end of said rod being driveable into an unhardened taphole clay;

a mount having a front and a rear;

a front support for supporting the rod at the front of said mount;

a sliding rear support for supporting the rod at the rear of said mount;

a first clamp, mounted in a sliding manner on the mount, the rod passing axially through said first clamp, said first clamp including means for releasably gripping the rod at any place between its front end and its rear end and for transmitting an axial pushing force to said rod in order to drive it into the taphole clay;

a first hydraulic jack slidably disposed on said mount, said first hydraulic jack having a stroke L which is shorter than the length of said rod, said first clamp being connected to said first hydraulic jack;

a drive means for moving said first hydraulic jack along said mount from a front position to a rear position and vice versa, said drive means being disposed on said mount; and a coupling means for engaging the rear end of said rod, said coupling means being adapted for transmitting an axial pulling force to said rear end of the rod for pulling said rod out of a hardened taphole clay and said coupling means being movable as a unit with said clamp means during removal of said rod from the taphole clay;

the process comprising the steps of:

(a) for driving the rod into the taphole clay;

(1) mounting said rod on said mount by axially passing one end of said rod through said first clamp and by supporting said front end of said rod by said front support and said rear end of the rod by said rear support;

(2) actuating said drive means for moving said hydraulic jack to the front end of the mount, said means for gripping the rod being released;

(3) at said front end of the mount, gripping the rod with said gripping means at a distance (D) from the shaft furnace, said distance (D) being shorter than the buckling length of said rod;

(4) actuating said first hydraulic jack for movement of the clamp over said stroke (L) towards the shaft furnace;

(5) releasing said gripping means of the clamp;

(6) actuating said first hydraulic jack for movement of the clamp over said stroke (L) in the opposite direction of the shaft furnace;

(7) repeating the operation of steps (3), (4), (5), (6) and (7) until the rod is driven into the taphole clay over the desired length;

(b) for extracting the rod from the hardened taphole clay, in order to open the taphole;

(1') actuating said drive means for moving said first hydraulic jack to the front end of the mount, said means for gripping the rod being released;

(2') actuating said first hydraulic jack for advancing the clamp over said stroke (L) towards the shaft furnace and engaging the rear end of the rod through said clamp;

(3') coupling said coupling means to said rear end of the rod; and (4') simultaneously actuating said first jack and said drive means, for moving said clamp and said coupling means as a unit from the front of the mount to the rear of the mount.

* * * * *